US005725174A

United States Patent [19]

Kothmeier

[11] Patent Number: 5,725,174

[45] Date of Patent: Mar. 10, 1998

[54] WINDING APPARATUS FOR A YARN ADVANCING AT A CONSTANT SPEED

[75] Inventor: Georg Kothmeier, Ingolstadt, Germany

[73] Assignee: Barmag-Spinnzwirn GmbH, Chemnitz, Germany

[21] Appl. No.: 592,362

[22] PCT Filed: Jun. 2, 1995

[86] PCT No.: PCT/DE95/00719

§ 371 Date: Apr. 26, 1996

§ 102(e) Date: Apr. 26, 1996

[87] PCT Pub. No.: WO95/33671

PCT Pub. Date: Dec. 14, 1995

[30] Foreign Application Priority Data

| | | | |
|---|---|---|---|
| Jun. 6, 1994 | [DE] | Germany | 44 19 774.8 |
| Jul. 2, 1994 | [DE] | Germany | 44 23 315.9 |
| Dec. 7, 1994 | [DE] | Germany | 44 43 515.0 |

[51] Int. Cl.[6] ..... B65H 59/38

[52] U.S. Cl. ..... 242/413.5; 242/417

[58] Field of Search ..... 242/417, 413.1, 242/413.5, 413.6

[56] References Cited

U.S. PATENT DOCUMENTS

| | | | |
|---|---|---|---|
| 3,713,009 | 1/1973 | Poppinger et al. . | |
| 4,234,133 | 11/1980 | Enneking | 242/413.5 |
| 4,966,333 | 10/1990 | Bosch . | |
| 5,277,373 | 1/1994 | Morton | 242/413.5 |
| 5,541,832 | 7/1996 | Nakajima et al. | 364/148 |
| 5,566,065 | 10/1996 | Hansen et al. | 364/164 |

FOREIGN PATENT DOCUMENTS

| | | |
|---|---|---|
| 0 478 153 | 4/1992 | European Pat. Off. . |
| 39 33 048 | 4/1990 | Germany . |

*Primary Examiner*—Michael Mansen

*Attorney, Agent, or Firm*—Bell Seltzer Intellectual Property Law Group of Alston & Bird LLP

[57] ABSTRACT

The yarn advances to the winding machine at a constant speed. The takeup speed is controlled in that the yarn is guided over a compensating arm. In addition to the measured value, which represents the position of the compensating arm, the speed is also determined, at which the compensating arm changes its position. Both measured values are superposed and used for determining a control value for the motor of the spindle.

5 Claims, 2 Drawing Sheets

WINDING APPARATUS FOR A YARN ADVANCING AT A CONSTANT SPEED

BACKGROUND OF THE INVENTION

The present invention relates to an apparatus for winding a yarn which advances at a constant speed.

DE 39 33 048 discloses an apparatus of the described type and which includes a traversing mechanism for reciprocating the yarn transversely to its direction of advance, a winding spindle which is driven by a spindle motor, a compensating arm which monitors the slack of the yarn upstream of the traversing mechanism, a measuring device for generating a measured value of the position of the compensating arm, and a controller which converts the measured value of the position to a control value for the motor.

In the above described apparatus, the slack of the compensating arm is controlled via the adjustment of the spindle speed by means of a PI controller, which is switched on after threading the yarn and after starting up the yarn traversing mechanism. Due to the considerable integral proportion of the controller, the spindle drive motor responds only with a delay to changes in the slack of the yarn loop formed by the compensating arm. Disadvantageous in this connection is that for purposes of threading the yarn it is necessary to switch over to a PD controller.

It is the object of the invention to further improve the winding machine with its control such that the control is in a position to level off, without a switchover, all oscillations in the position of the compensating arm, even those oscillations which are caused by the reciprocating movements of the yarn traversing mechanism.

SUMMARY OF THE INVENTION

The above and other objects and advantages of the present invention are achieved by the provision of a winding apparatus which comprises a winding spindle which is adapted to coaxially receive a winding tube, a drive motor for rotating the winding spindle, and a yarn traversing mechanism for reciprocating the advancing yarn transversely along the winding spindle. A compensating arm system is provided for monitoring the slack of the advancing yarn upstream of the yarn traversing mechanism and which includes a pivotally mounted compensating arm which is pivoted upon a difference between the take up speed and the speed of the advancing yarn. A sensor is provided for sensing the pivotal position and the speed of pivotal movement of the compensating arm, and generating a pivotal position value and a speed of pivotal movement value, with the speed of pivotal movement value representing the direction of movement and the speed of the compensating arm. Also, a controller is provided which acts to superimpose the pivotal position value and the speed of pivotal movement value of the sensor and so as to produce a control value which controls the speed of the drive motor as a function of the superimposed values.

The above apparatus achieves an interdependence of the motor speed on the one hand and the position and speed of the compensating arm on the other, without the planned changes in the position and the speed of the compensating arm, which are caused in particular by the yarn traversing mechanism, exerting a negative influence on the adjustment of the spindle speed, and without leading in particular to fluctuations of the spindle speed.

It is thereby accomplished to impart a nonlinear performance to the entire control circuit which consists of the spindle, the spindle drive motor, the controller, and the compensating arm. This means, that not every change with respect to the position and/or speed of the compensating arm leads to a proportional change in the control value which is predetermined for the drive motor of the winding spindle for adjusting the spindle speed.

As a result of the design of the invention, and as described in detailed below, it is further achieved that the controller is programmable and adjustable within wide ranges, so as to be able to cover all operating conditions and to convert same into discrete control values, and so as to be able to sensitively adapt the control to occurring operating conditions, with even extreme conditions, such as, for example, threading and startup, requiring no switchover.

Nevertheless, it is useful to generate discrete, clear control values, which consider the position of the actually measured values in reasonable manner, as occurs in particular when the motor control value is selected such that it is the abscissa of the center of gravity of the entire surface, which is circumscribed by the envelope curve of the previously weighted quantity ranges of the control value.

BRIEF DESCRIPTION OF THE DRAWINGS

Some of the objects and advantages of the present invention having been stated, others will appear as the description proceeds and when considered together with the accompanying drawings, in which.

DETAILED DESCRIPTION OF THE PREFERRED EMBODIMENT

Figure 1:
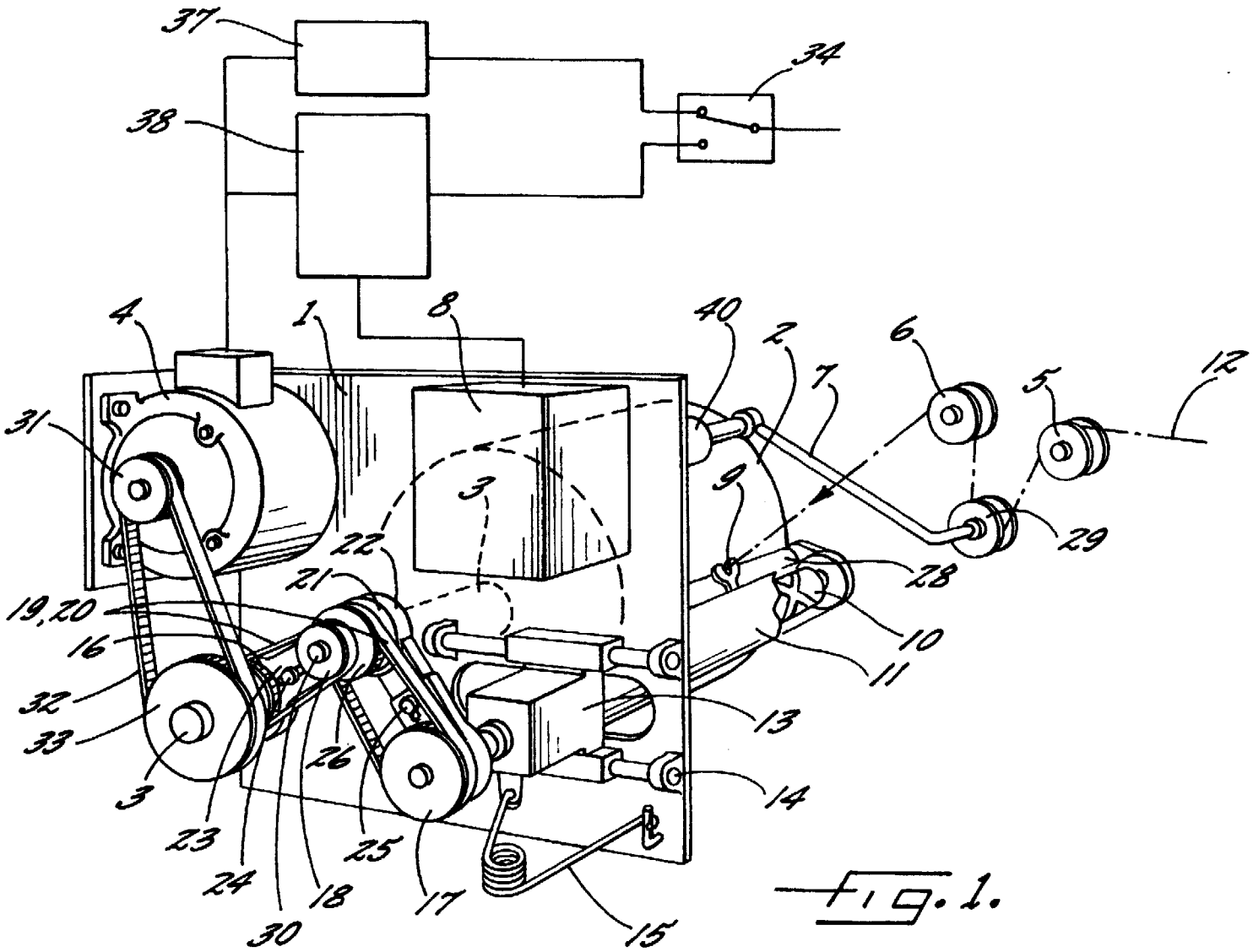
FIG. 1 is a fragmentary, partly schematic, view of a yarn winding apparatus which embodies the present invention.

Referring more particularly to the drawings, FIG. 1 illustrates a precision cross winding head which embodies the present invention. A plurality of such heads are typically arranged side by side in several horizontal and vertical rows in a precision cross winding machine.

The precision cross winding head is arranged on a vertical support plate 1. Mounted on support plate 1 and projecting therefrom is a winding spindle 3, which accommodates a package with its winding tube. Associated to winding spindle 3 is a traversing mechanism for reciprocating an advancing yarn 12. The yarn traversing mechanism extending parallel to the package consists of a housing 11, which accommodates a rotatably supported cross-spiralled roll 10 and a traversing yarn guide 9 which is reciprocated by the cross-spiralled roll in a straight guideway and deposits the yarn 12 on the package. To maintain a constant distance between the surface of package 2 and the yarn traversing mechanism, a support roll 28 is arranged for free rotation on the housing 11 of the yarn traversing mechanism.

The yarn traversing mechanism with the cross-spiralled roll is mounted on a carriage 13. The carriage 13 is supported in a guideway 14, which permits a straight-line movement in radial direction or in direction of a secant with respect to the package. A spring 15 is acting upon the carriage in such a manner that the yarn traversing mechanism rests with its support roll 28 against the package surface during the entire winding cycle, but can make way to the increasing diameter of package 2.

Before being deposited by traversing yarn guide 9, the supplied yarn 12 advances over two stationary guide rolls 5 and 6, between which a compensating arm 7 with a roll 29 is arranged for pivotal movement. The compensating roll lies on the yarn under the weight of the compensating arm. The increase of package 2 and the shortening of the yarn loop (slack) formed between yarn guides 5 and 6 cause a change in the pivot angle of the compensating arm and, as a function thereof, the speed of a drive motor 4 for the winding spindle is electronically readjusted by a mechanical-electrical compensating arm control 8.

Mounted on the other side of the support plate (in front when looked at by the viewer), is the drive motor 4 for the operation of winding spindle 3. This motor drives centrally, via a toothed belt pulley 31 and a toothed belt 32, a toothed belt pulley 33 rigidly secured to the end of winding spindle 3 projecting on this side from the support plate and, thus, the winding spindle 3. The winding spindle is operatively connected with cross-spiralled roll 10, namely by toothed belt pulley 16 and toothed belt 19, as well as toothed belt pulley 18 with an intermediate shaft 30, and from there by a further toothed belt pulley 26, via toothed belt 20 and toothed belt pulley 17 with cross-spiralled roll 10. With respect to winding spindle 3 and with respect to cross-spiralled roll 10, the intermediate shaft 30 is supported by a rocking lever 23 and 22 respectively, and rotatably arranged on the free ends of these rocking levers.

As a result of the operative connection between winding spindle 3 and cross-spiralled roll 10, the ratio of the winding spindle speed to the traversing frequency is constant during the entire winding cycle.

The yarn advances at a constant speed, thereby forming a slack between yarn guides 5 and 6 due to the constant weight of compensating arm 7 with compensating roll 29, which may be increased for example by a spring. The magnitude of this slack is determined, on the one hand, by the speed of the advancing yarn and, on the other hand, by the takeup speed. The magnitude of this slack is adjusted to a constant value. However, in so doing, it is necessary to allow for fluctuations which develop as a result of the traversing motion. To this end, the axis of the compensating arm is connected to a controller 8. The controller 8 controls the drive motor 4. When the slack of the yarn increases and, consequently, the compensating arm 7 is rotated clockwise, the drive speed of spindle motor 4 is increased. When the slack decreases, the drive speed is reduced. The compensating arm 7 and controller 8 are thus included in a control circuit, which adjusts the slack of the yarn loop between yarn guides 5 and 6.

More specifically, the control of drive motor 4 is designed such that the following functions are performed:

For threading the yarn, the drive motor 4 is switched by means of a switch 34 on the compensating arm, so that the motor 4 drives the winding head (package 2) via a threading speed controller 37 at a constant predetermined drive speed. The speed is selected such that the circumferential speed of the empty tube clamped on winding spindle 3 is higher than the yarn speed.

For catching the yarn, the carriage 13, which supports the yarn traversing mechanism with traversing yarn guide 9 and cross-spiralled roll 10, is moved to the right in the Figure, so that supporting roll 28 is removed from the circumference of the empty tube, and the traversing yarn guide 9 does not come into contact with the yarn.

For threading, the yarn is initially guided over yarn guides 5 and 6 and looped about compensating roll 29. Subsequently, the yarn is brought in contact with the empty tube and caught by the rotating empty tube.

As a result, the compensating arm 7 rises from its lower stop position, thereby switching from threading speed controller 37, via switch 34 on the compensating arm, to compensating arm controller 38.

The compensating arm with its roll 29 is connected to a rotary sensor 40. The rotary sensor detects the position and the speed of the compensating arm. The sensor may be, for example, a magnetoresistive sensor. This magnetoresistive sensor is provided with a ferromagnetic layer which is included in a circuit. Operative on this ferromagnetic layer is a magnet which is rotatable along with the compensating arm. As a result of the change in the rotated position of the magnetic field, the electric resistance of the ferromagnetic layer changes likewise, so that the voltage drop on the ferromagnetic layer is a measure for the rotated position of the compensating arm.

In addition to the position of the compensating arm, the speed of the compensating arm is measured likewise, namely by magnitude and direction. To this end, the measurement is repeated in predetermined time intervals, and the speed is determined therefrom. The continuously determined measuring data of the position and measuring data of the speed are now supplied to the controller.

The controller has a memory with different areas.

Figure 2A:
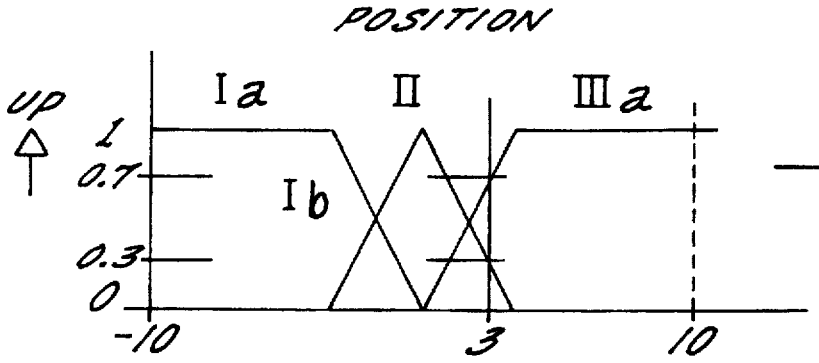
FIGS. 2A–2D are diagrams illustrating the measuring and control functions of the present invention.

Stored in the position area are position quantity ranges. These position quantity ranges are shown in FIG. 2A. The quantity ranges define a pertinent value, at which a certain measured value of the position is assigned to the previously defined position quantity range. These pertinent values are on a scale from 0 to 1. Each quantity range is divided into a main range and a transitional range. In the main range, the pertinent value is the value 1. In the transitional range, the pertinent value drops toward the respectively adjacent quantity range from 1 to 0, there occurring, however, overlaps with the adjacent transitional range.

Shown in FIG. 2A are position quantity ranges I to III.

For example in FIG. 2A, the horizontal line of the main range Ia describes the position quantity range: "far down". This means that all measured data of the compensating arm position, which lie between (for example) 10 and 5 measured value units, are defined as "far down" with a pertinent value UP=1. The transitional range Ib of quantity range I covers all measured values, which may be allocated to the quantity range "far down" only with limitations.

The quantity range II covers all measured values which one would describe as "intermediate". This quantity range II has a pertinent value UP=1 only at one point. As can be noted from the diagram, a measured value of, for example, 3 measuring units would be assigned both to the quantity range II with the pertinent value 0.3 and to the quantity range III with the pertinent value 0.7. In similar manner, the quantity range III defines all measured position values, which one would describe as "very high."

Figure 2B:
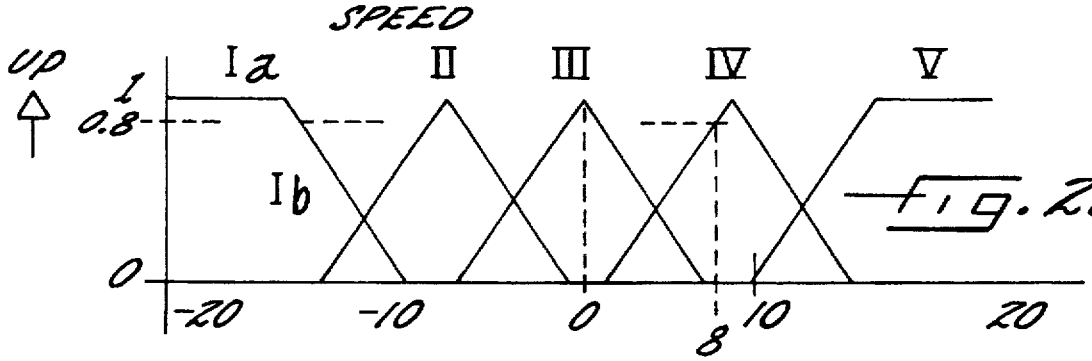

In similar manner, all occurring measured values of the speed are assigned to predetermined speed quantity ranges which are stored in a speed area of the memory. The entire scale of occurring measured values is divided, as shown in FIG. 2B, into five quantity ranges I, II, III, IV, and V, wherein Quantity range I covers all measured values which are directed downward and "very high;"

Quantity range II covers all measured values which are directed downward and "medium high;"

Quantity range III covers all measured values which are to be classified as substantially "equal to zero" or as "low;"

Quantity range IV covers all measured values which are directed upward and to be classified as "medium high;" and Quantity range V covers all measured values which are directed upward and "very high."

Furthermore, there is a memory area, to which all applicable output signals of the controller—also referred to as 'control value' within the scope of the application, are allocated to predetermined quantity ranges of the control value.

Figure 2C:
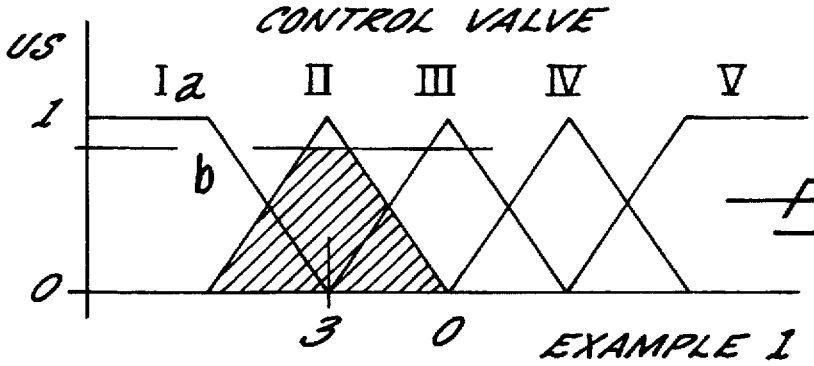

As shown in FIG. 2C, the scale of occurring control values is divided into five quantity ranges. The applicable control values are assigned to the following quantity ranges:

I: Decrease speed considerably;

II: Decrease speed less considerably;

III: Leave speed constant;

IV: Increase speed less considerably; and

V: Increase speed considerably.

The memory further possesses an area, in which every occurring combination of quantity ranges of the position and quantity ranges of the speed is assigned as a control algorithm to a certain quality range of the control value, as shown in FIG. 2C.

The selected subdivision of the quantity ranges includes 15 of such combinations. The control algorithm reads, for example:

If the speed belongs to the quantity range "positive medium", and if the position of the compensating arm belongs to the quantity range "far up", the control value may be taken from the quantity range "negative medium"= "decrease speed less considerably."

In a first example, the position of the compensating arm is assumed to be 'positive 10 measuring units' and its speed 'positive 8 measuring units'. This means that the actually measured value of the position is assigned to the position quantity range III corresponding to "far up" and having a pertinent value UP=1. The actually measured value of the speed is assigned to the speed quantity range VI corresponding to "positive medium" and having a pertinent value UP=0.8.

Consequently from the input control algorithm (which has accidentally been cited already), the computer unit of the controller reads that the quantity range II of the control value corresponding to increase the speed less considerably, is to be assigned to this combination.

In this connection, the value (performance value) of the control value, which pertains to the selected quantity range II results from multiplying the pertinent values for position and speed respectively assigned to their applicable quantity range. Before this multiplication or other superposition, the pertinent values may also be weighted, which reflects a measure of confidence for their allocation.

The result is the performance value.

In the present case, the weighting factor (measure of confidence) is assumed to equal 1 for both pertinent values. Thus, the pertinent value (performance value) for the control value in its selected quantity range results likewise in 0.8.

Shown in FIG. 2C is that, thus, in the quantity range II of the control value corresponding to "negative medium", the surface extending below the 0.8-horizontal indicates the range, from which the control value is selected. Likewise for this purpose, the computer contains a control algorithm. This control algorithm may, for example, say that the control value is the abscissa of the center of gravity of the surface, which is cut off from the applicable quantity range by the pertinent value. This surface is shaded in FIG. 2C. The abscissa of the center of gravity and, thus, the control value is −3. This value is input to the motor for reducing the speed.

In a further example, the actually measured value of the speed is again assumed to equal 8 measuring units, whereas the measured value of the position amounts to 3 measuring units.

This means that these measured values are assigned to the quantity range IV of the speed corresponding to "positive medium" as well as to the quantity range II of the position corresponding to "neutral" and having a pertinent value of 0.3, as well as to the quantity range III corresponding to "far up" and having a pertinent value of 0.7.

Further stored in the memory area for the control algorithm is:

If the speed is "positive medium" and the position is "neutral," the control value will be "neutral;" and in addition:

If the speed is "positive high" and the position is "neutral," the control value will be "negative medium."

Figure 2D:
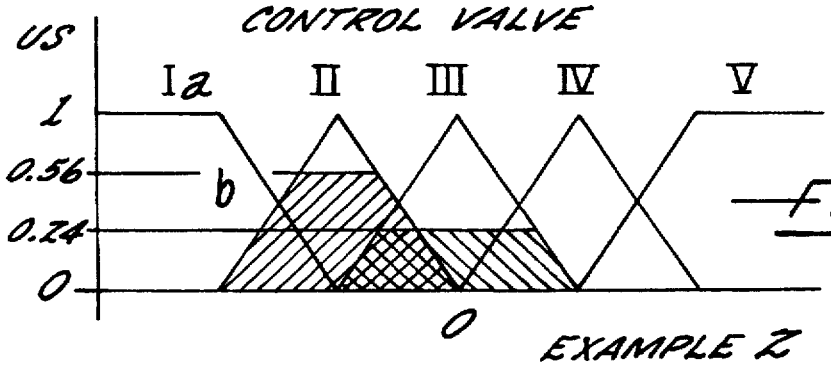

From the total of 15 control algorithms, the computer takes out of the memory this control algorithm and assigns accordingly the quantity ranges II and III of the control value to the actually measured value. This is shown in FIG. 2D. The value of the control value pertaining to the respective quantity range results from the pertinent values of the measured value that are assigned to quantity ranges of respectively the position and the speed by superposition as has been described above. Possibly, a multiplication may occur in addition by the measure of confidence, which is predetermined between zero (0) and one (1). In the present example, it equals 1. Thus, the quantity range II of the control value has a pertinent value of 0.7×0.8=0.56, and the quantity range III of the control value has a pertinent value of 0.3×0.8=0.24.

The surface marked by these pertinent values in the allocated ranges is again shaded in FIG. 2D.

The computer is now again programmed such that it determines the center of gravity of the surface, which is covered by the selected quantity ranges that are bounded by the respective pertinent values; i.e., the overlapping surface is computed only once. Otherwise, the sum of the quantity ranges is formed, which are bounded by the pertinent values assigned thereto.

When package 2 is fully wound, carriage 13 moves again to the right—in the FIG. 1—to its starting position. At the end of the winding cycle, or in the event of a yarn breakage, the compensating arm drops again to its lower position (threading position). As a result, switch 34 is again switched, and threading speed control 37 is activated. The threading speed on the newly replaced empty tube of the winding head is thus maintained constant for a renewed threading of the yarn.

I claim:

1. An apparatus for winding an advancing yarn, and comprising a winding spindle which is adapted to coaxially receive a winding tube, a drive motor for rotating the winding spindle, a yarn traversing mechanism for reciprocating the advancing yarn transversely along the winding spindle, a compensating arm system for monitoring the slack of the advancing yarn upstream of the yarn traversing mechanism and which includes a pivotally mounted compensating arm which is pivoted upon a difference between the take up speed and the speed of the advancing yarn, a sensor for sensing the pivotal position and determining the speed of pivotal movement of the compensating arm, and generating a pivotal position value and a speed of pivotal movement value, which speed of pivotal movement value represents the direction of movement and the speed of the compensating arm, and controller means which acts to superimpose the pivotal position value and the speed of pivotal movement value of the sensor and so as to produce a control value which controls the speed of the drive motor as a function of the superimposed values.

2. The yarn winding apparatus as defined in claim 1 wherein the controller means acts to superimpose the pivotal position value and the speed of pivotal movement value of the sensor by the steps of (a) assigning the pivotal position value and the speed of pivotal movement value to predetermined quantity ranges respectively, with each of the quantity ranges defining a pertinence of the associated pivotal position value and speed of pivotal movement value on a scale of pertinent values, and with each of the quantity ranges being divided into a main range to which a pertinent value of 1 is assigned and one or more transitional ranges in which the assigned pertinent value drops as it moves toward the adjacent quantity range from 1 to 0, and with adjacent transitional ranges overlapping one another;

(b) assigning to the pivotal position value and the speed of pivotal movement value the respective pertinent values of the predetermined quantity ranges;

(c) dividing all possible control values into a plurality of quantity ranges and allocating in a memory a predetermined quantity range of the control value to all occurring combinations of quantity ranges of the pivotal position value and the speed of pivotal movement value;

with each quantity range of the control value being divided into a main range to which a pertinent value of 1 is assigned, and into one or more transitional ranges in which the assigned pertinent value drops toward the adjacent quantity range from 1 to 0; and with adjacent transitional ranges overlapping one another;

(d) recalling from the memory the quantity range of the control value assigned to each actual combination of quantity ranges of the pivotal position value and the speed of pivotal movement value;

(e) forming a performance value for each actual combination by superimposing the pertinent values as determined from the pivotal position value and the speed of pivotal movement value as assigned to their respective quantity ranges;

(f) allocating to each of the recalled quantity ranges of the control value the performance value of the associated actual combination;

(g) performing a weighting of each of the recalled quantity ranges of the control value by the amount of the allocated performance value; and (h) selecting a control value which controls the speed of the drive motor such that it pertains to at least one of the weighted quantity ranges of the control value.

3. The yarn winding machine as defined in claim 2 wherein step (h) includes selecting a motor control value such that it is an abscissa of the center of gravity of a surface, which is cut off from the associated quantity range by the associated pertinent values of the pivotal position value and the speed of pivotal movement value.

4. The yarn winding apparatus as defined in claim 1 wherein the drive motor is operatively connected to the yarn traversing mechanism so that the ratio of the winding spindle speed and the traversing speed is constant.

5. The yarn winding apparatus as defined in claim 4 wherein said controller includes a switch which is responsive to the pivotal position of said compensating arm for operating the drive motor at a thread up speed or at a normal winding speed.

* * * * *